US005396849A

United States Patent [19]

Boyd

[11] Patent Number: 5,396,849

[45] Date of Patent: Mar. 14, 1995

[54] COMBUSTION METHOD PRODUCING LOW LEVELS OF POLLUTANTS AND APPARATUS FOR SAME

[75] Inventor: Thomas J. Boyd, Huntersville, N.C.

[73] Assignee: Electric Power Research Institute, Inc., Palo Alto, Calif.

[21] Appl. No.: 219,952

[22] Filed: Mar. 30, 1994

[51] Int. Cl.[6] ..... F23B 7/00

[52] U.S. Cl. ..... 110/342; 110/245; 110/263; 110/345; 110/347

[58] Field of Search ..... 110/347, 245, 342, 345, 110/185, 190, 263

[56] References Cited

U.S. PATENT DOCUMENTS 4,843,981 7/1989 Goldbach et al. ..... 110/347
4,845,942 7/1989 Schemenau et al. .
4,928,635 5/1990 Shelor .
5,163,374 11/1992 Rehmat et al. ..... 110/342

*Primary Examiner*—Edward G. Favors
*Attorney, Agent, or Firm*—Flehr, Hohbach, Test, Albritton & Herbert

[57] ABSTRACT

A method for combusting a fossil material so as to produce an exhaust stream having a low level of pollutants. The fossil material is introduced into a fluidized bed combustor which is operated at a temperature of at least approximately 1775° F. to produce a partially cleansed exhaust stream having a low level of $N_2O$. $SO_2$ is removed from the partially cleansed exhaust stream outside of the fluidized bed combustor to produce a cleansed exhaust stream having a low level of $SO_2$. An apparatus is provided for performing the method of the invention.

16 Claims, 1 Drawing Sheet

COMBUSTION METHOD PRODUCING LOW LEVELS OF POLLUTANTS AND APPARATUS FOR SAME

BRIEF DESCRIPTION OF THE INVENTION

This invention relates to methods and apparatus for combusting fossil materials and more particularly to the combustion of fossil materials in a fluidized bed combustor.

BACKGROUND OF THE INVENTION

Atmospheric fluidized bed combustors are known in the art for combusting fossil fuel materials such as coal. Problems have been encountered, however, in improving the environmental performance of fluidized bed combustors by, for example, minimizing $SO_2$, $NO_x$ and CO emissions, minimizing the formation of $N_2O$ and reducing solid waste products through a decrease in sorbent demand.

Although fluidized bed combustors are capable of the simultaneous control of both $SO_2$ and $NO_x$, newly introduced emission limitations are pushing the technology toward the limits of economic $SO_2$ removal. Fluidized bed combustors require a relatively low combustion temperature, typically ranging from approximately 1500° to 1600° F., to optimize sorbent utilization. At these temperatures, fluidized bed combustors require calcium-to-sulfur molar ratios ranging from approximately 1.5 to over 2.5 to achieve $SO_2$ reductions of approximately 70% to 90%, depending on the type of coal and emission targets. Fluidized bed combustors can achieve greater than 95% $SO_2$ removal with in-situ sulfur retention or removal chemistry, but require calcium-to-sulfur molar ratios in excess of 3.0 to do so.

The high sorbent requirements in reducing $SO_2$ emissions in fluidized bed combustors beyond those obtainable under optimal temperatures result in less efficient conversions and solid waste production of approximately 500 lbs for each MBtu of high sulfur coal combusted. In comparison, a pulverized coal fired boiler having a flue gas desulfurization system and operating under similar emission targets produces only approximately 375 lbs for each MBtu generated from the combustion of high sulfur coal.

The relatively low combustion temperatures required to maintain efficient sulfur capture also affect other emissions, including $N_2O$, $NO_x$ and CO. Although emissions from combustors are currently unregulated, they may be a target for regulation in the future since $N_2O$ is considered a green house gas. The amount of $N_2O$ generated from a combustion process generally decreases with increased combustion temperature. For example, the amount of $N_2O$ generated from the combustion of high sulfur coal at 3% $O_2$ is approximately 130 parts per million at 1500° F. and approximately 90 parts per million at 1600° F.

The relatively low combustion temperatures of atmospheric fluidized bed combustors result in approximately 0.25 lb. $NO_x$ for each MBtu generated from the combustion of coal. The amount of CO generated from atmospheric fluidized bed combustors at these temperatures is generally less than 100 parts per million. CO emissions generally decrease with increased combustion temperature.

OBJECTS AND SUMMARY OF THE INVENTION

The primary object of the present invention is to provide a method and apparatus for combusting fossil material in which the emissions produced thereby have low levels of $SO_2$, $NO_x$, CO and $N_2O$.

Another object of the invention is to provide a method and apparatus of the above character in which a fluidized bed combustor is operated under conditions efficient for controlling $N_2O$ and CO emissions.

Another object of the invention is to provide a method and apparatus of the above character in which $SO_2$ emissions are controlled either partially or totally downstream of the fluidized bed combustor with a flue gas desulfurization system.

Another object of the invention is to provide a method and apparatus of the above character in which $NO_x$ emissions are controlled through integrating a selective noncatalytic reductions system using ammonia injection into the fluidized bed combustor.

These and other objects are achieved by a method for combusting a fossil material so as to produce an exhaust stream having a low level of pollutants. The fossil material is introduced into a fluidized bed combustor operated at a temperature of at least approximately 1775° F. to produce a partially cleansed exhaust stream having a low level of $N_2O$. $SO_2$ is removed from the partially cleansed exhaust stream outside of the fluidized bed combustor to produce a cleansed exhaust stream having a low level of $SO_2$. An apparatus is provided for performing the method of the invention.

Additional objects and features of the invention will appear from the following description from which the preferred embodiments are set forth in detail in conjunction with the accompanying drawing.

DETAILED DESCRIPTION OF THE INVENTION

Figure 1:
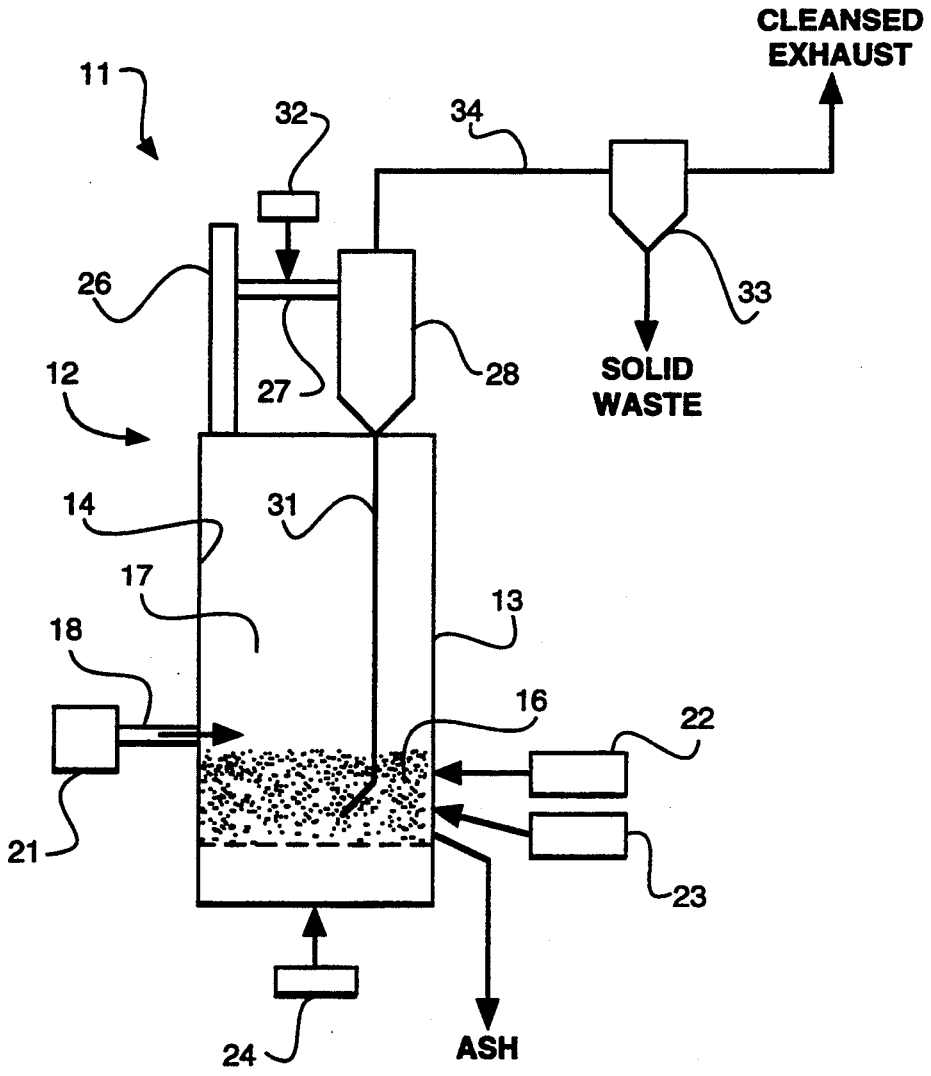
FIG. 1 is a schematic view of a system having a fluidized bed combustor and incorporating the method of the present invention.

Reference will now be made in detail to the preferred embodiment of the invention which is illustrated in FIG. 1. The description of the embodiment of the invention will be followed by a discussion of its operation.

Advanced emissions fluidized bed combustor apparatus 11 of the present invention includes an atmospheric fluidized bed combustor 12 of the type known in the art and formed from a vessel or container 13 having a chamber 14 therein. A dry bubbling fluid bed 16 consisting essentially of particles of coal or other fossil material to be combusted or burned is provided in chamber 14 and a freeboard area 17 is located over fluid bed 16.

Properly sized coal is introduced into chamber 14 through line 18 by means of a conventional introduction device or mechanism 21 which is capable of regulating the flow of the coal into the chamber. A fuel injector 22 is provided for, among other things, initiating the combustion process of fluidized bed combustor 12 and limestone can be provided to container 13 by any suitable means such as feeder mechanism 23.

Means for supplying ambient air into the bottom of chamber 14 includes a forced draft fan 24 having a control damper (not shown) and serving as means for controlling the flow rate of air entering chamber 14.

The forced air so supplied into the chamber serves to fluidize and circulate the coal so as to form fluid bed 16. Fan 24, together with coal introduction mechanism 21, is included within the means of apparatus 11 for maintaining a desired operating temperature within container 13.

Apparatus 11 is provided with a selective noncatalytic reductions system for controlling $NO_x$emissions. In this regard, the partially cleansed exhaust stream from chamber 14 flow from freeboard area 17 through riser 26 and duct 27 to cyclone 28 which serves to separate the gas and particulate byproducts therein by weight. The heavier materials are returned to fluid bed 16 through return pipe 31. Means for injecting ammonia into fluidized bed combustor 12 is provided and includes ammonia injector 32 which introduces ammonia into duct 27.

Apparatus 11 has means which includes a flue gas desulfurization system for removing $SO_2$ from the exhaust gases of fluidized bed combustor 12. More in particular, a wet or dry scrubber 33 is connected by line 34 to cyclone 28 for receiving the exhaust gases segregated from the outflow of chamber 14 by the cyclone. Scrubber 33 remove $SO_2$ from these exhaust gases by a process known to those skilled in the art. If a dry scrubber is utilized, the fluidized bed combustor can be utilized for producing all or a portion of the sorbent required by the scrubber. The solid waste produced from the cleansing process of scrubber 33 is disposed.

In operation and use, apparatus 11 of the present invention can be used to combust a fossil material such as coal in a process which produces an exhaust stream having relatively low levels of pollutants or contaminants. Unlike current atmospheric fluidized bed combustors, advanced emissions fluidized bed combustor apparatus 11 is focused on $N_2O$ and $NO_x$ control and minimization rather than $SO_2$ control. Apparatus 11 optimizes the operating conditions for each of these sets of chemical reactions by separating these emission reduction stages.

$N_2O$ and CO emissions are regulated by operating fluidized bed combustor 12 under conditions which minimize $N_2O$ and CO emissions. For a given rate of coal introduced into the fluidized bed combustor by introduction mechanism 21, ambient air is supplied to chamber 14 by fan 24 at a rate which permits optimal control of $N_2O$ emissions. In this regard, fluidized bed combustor 12 is operated at a temperature of at least approximately 1775° F., and preferably at a temperature ranging from approximately 1775° to 1825° F., to produce a partially cleansed exhaust stream having a low level of $N_2O$. These higher operating temperatures also result in reduced CO emissions.

Apparatus 11 focuses on efficient in-situ $NO_x$ control. Although the higher operating temperatures of fluidized bed combustor 12 result in higher initial formation of $NO_x$, the amount of $NO_x$ generated from the combustion of high sulfur coal at 3% $O_2$ being approximately 250 parts per million at 1775° F., these $NO_x$ emissions are easily controlled with the selective noncatalytic reductions system integrated into fluidized bed combustor 12. The operating temperature and good mixing attributes of fluidized bed combustors are ideally suited for selective noncatalytic reductions systems using ammonia injection. The ammonia from ammonia injector 32 serves to suppress $NO_x$ and permit the fluidized bed combustor to produce a cleansed exhaust stream having a relatively low level of $NO_x$.

Either partial or total sulfur retention is accomplished by apparatus 11 outside of fluidized bed combustor 12 through backend scrubbing. In this regard, the lighter material segregated by cyclone 28 is directed through scrubber 33 which removes $SO_2$ from this partially cleansed exhaust stream to produce a cleansed exhaust stream having a relatively low level of $SO_2$. Depending upon the sulfur content of the coal being combusted by apparatus 11, scrubber 33 can be utilized to remove some or all of the $SO_2$ from the exhaust of fluidized bed combustor 12. For coals having a relatively high sulfur content, scrubber 33 may operate in tandem with limestone feeder mechanism 23 to accomplish the desired sulfur retention. For coals having lower sulfur contents, apparatus 11 may not require feeder mechanism 23 for effective $SO_2$ removal and can still be within the scope of the present invention.

Although the addition of downstream scrubber 33 raises the capital cost of the advanced emissions fluidized bed combustor apparatus 11, the overall cost of the electricity produced should be lower than a pulverized coal fired boiler equipped with a flue gas desulfurization system and a selective catalytic reductions system and producing emissions comparable to those of apparatus 11. The additional capital cost is offset by the lower cost of the selective noncatalytic reductions system compared to the selective catalytic reductions system for a pulverized coal fired boiler. In addition, maintenance costs are significantly less for selective noncatalytic reductions systems and there is no hazardous waste catalyst to dispose of or replace. Apparatus 11 reduces the externality costs below those likely to be levied on a conventional atmospheric fluidized bed combustor plant because of both the reduced solid waste and the lower emissions of $SO_2$, $NO_x$, $N_2O$ and CO. The increased combustion efficiency of apparatus 11 will also result in a reduced heat rate and decreased $CO_2$ emissions.

Apparatus 11 is expected to achieve $N_2O$ emissions of less than 10 parts per million and CO emissions of less than 50 parts per million. The formation of $NO_x$ in the cleansed exhaust stream from apparatus 11 is expected to be less than 0.1 lb., and possibly 0.05 lb., for each MBtu generated; the $NH3/NO_x$ ratio is expected to be approximately 5:1.

It is estimated that apparatus 11 can achieve sulfur retention of 98% or greater with any fuel, as compared to 90% for current atmospheric fluidized bed combustors processing coals having relatively high sulfur content and 95% for these fluidized bed combustors processing coals having relatively low sulfur content. Calcium-to-sulfur molar requirements of apparatus 11 are expected to be 1.2 or lower for 98% sulfur retention, while solid waste generation is expected to be approximately 375 lbs. for each MBtu generated from the combustion of high sulfur coal or approximately 25% less than the solid waste generated by atmospheric fluidized bed combustors having comparable emission capabilities. The emission targets of apparatus 11 are comparable to those of any advanced emissions control coal-based technology currently available.

As can be seen from the foregoing, a method and apparatus have been provided for combusting fossil material in which the emissions produced thereby have low levels of $SO_2$, $NO_x$, CO and $N_2O$. In this method and apparatus, a fluidized bed combustor is operated under conditions efficient for controlling $N_2O$ and CO emissions. $SO_2$ emissions are controlled downstream of the fluidized bed combustor with a flue gas desulfurization system. $NO_x$ emissions are controlled through integrating a selective noncatalytic reductions system using ammonia injection into the fluidized bed combustor.

What is claimed is:

1. A method for combusting a fossil material so as to produce an exhaust stream having a low level of pollutants comprising the steps of introducing the fossil material into a fluidized bed combustor having a chamber, operating the fluidized bed combustor chamber under at least stoichiometric conditions and at a temperature of at least approximately 1775° F. to produce a partially cleansed exhaust stream having low levels of $N_2O$ and CO and removing $SO_2$ from the partially cleansed exhaust stream from the fluidized bed combustor chamber with a sorbent to produce a cleansed exhaust stream having a low level of $SO_2$, the removal of the $SO_2$ occurring outside of the fluidized bed combustor chamber to permit the fluidized bed combustor chamber to be operated at temperatures without regard to efficient sorbent utilization therein.

2. The method of claim 1 further comprising the step of injecting ammonia into the fluidized bed combustor to produce a cleansed exhaust stream having a low level of $NO_x$.

3. The method of claim 2 wherein said injecting step includes the step of producing a cleansed exhaust stream having less than 0.1 lb. of $NO_x$ for each MBtu generated.

4. The method of claim 1 wherein said operating step includes the step of operating the fluidized bed combustor chamber at a temperature ranging from approximately 1775° to 1825° F.

5. The method of claim 1 wherein said removing step includes the step of removing $SO_2$ from the partially cleansed exhaust stream in a scrubber.

6. The method of claim 1 further comprising the step of selecting high sulfur coal as the fossil material to be combusted and the step of producing no more than approximately 375 lbs. of solid waste from the removal of $SO_2$ from the partially cleansed exhaust stream for each MBtu generated.

7. The method of claim 1 wherein said operating step includes the step of producing a partially cleansed exhaust stream having a level of $N_2O$ less than 10 parts per million.

8. The method of claim 1 wherein said operating step includes the step of producing a partially cleansed exhaust stream having a level of CO less than 50 parts per million.

9. The method of claim 1 further comprising the step of selecting a coal as the fossil material to be combusted.

10. A method for burning coal so as to produce an exhaust stream having a low level of pollutants comprising the steps of combusting the coal in a fluidized bed combustor having a chamber maintained at a temperature of at least approximately 1775° F. to produce a partially cleansed exhaust stream having low levels of $N_2O$ and CO, removing $SO_2$ from the partially cleansed exhaust stream with a sorbent in a scrubber located downstream of the fluidized bed combustor chamber to produce a cleansed exhaust stream having a low level of $SO_2$ and injecting ammonia into the fluidized bed combustor to produce a cleansed exhaust stream having a low level of $NO_x$.

11. The method of claim 10 wherein the removing step includes utilizing calcium-to-sulfur molar requirements of 1.2 or lower.

12. An apparatus for combusting a fossil material so as to produce an exhaust stream having a low level of pollutants comprising a fluidized bed combustor having a chamber, means for introducing the fossil material into the fluidized bed combustor, means for maintaining the fluidized bed combustor chamber at stoichiometric conditions or above and at an operating temperature of at least approximately 1775° F. so as to produce a partially cleansed exhaust stream having low levels of $N_2O$ and CO and means apart from the fluidized bed combustor chamber for removing $SO_2$ from the partially cleansed exhaust stream so as to produce a cleansed exhaust stream having a low level of $SO_2$, the $SO_2$ removal means apart from the fluidized bed combustor chamber permitting the fluidized bed combustor chamber to be maintained at temperatures without regard to efficient sorbent utilization therein.

13. The apparatus of claim 12 further comprising means for injecting ammonia into the fluidized bed combustor so as to produce a cleansed exhaust stream having a low level of $NO_x$.

14. The apparatus of claim 12 wherein said maintaining means includes means for maintaining the fluidized bed combustor at a temperature ranging from approximately 1775° to 1825° F.

15. The apparatus of claim 12 wherein said $SO_2$ removal means apart from the fluidized bed combustor chamber includes a scrubber.

16. The method of claim 1 wherein the removing step includes utilizing calcium-to-sulfur molar requirements of 1.2 or lower.

* * * * *